US006382077B1

(12) United States Patent
Chen

(10) Patent No.: US 6,382,077 B1
(45) Date of Patent: May 7, 2002

(54) AIR PRESSURE TUBE ASSEMBLY FOR ELEVATION-ADJUSTABLE SEAT STAND

(76) Inventor: Gorden Chen, No. 2, Alley 31, Lane 71, Fuhsing Rd., Sec. 2, Taichung (TW)

( * ) Notice: Subject to any disclaimer, the term of this patent is extended or adjusted under 35 U.S.C. 154(b) by 0 days.

(21) Appl. No.: 09/668,006

(22) Filed: Sep. 21, 2000

(51) Int. Cl.[7] ..... F15B 11/08
(52) U.S. Cl. ..... 91/437; 92/169.1
(58) Field of Search ..... 91/437; 92/169.1, 92/171.1; 207/338, 344.16, 344.12, 344.18, 344.19

(56) References Cited

U.S. PATENT DOCUMENTS 977,736 A * 12/1910 Hanson ..... 297/344.16
4,465,266 A * 8/1984 Hale ..... 297/344.12
6,102,354 A * 8/2000 Thorn ..... 297/344.19
6,276,756 B1 * 8/2001 Cho et al. ..... 297/344.19

* cited by examiner

*Primary Examiner*—Edward K. Look
*Assistant Examiner*—Igor Kershteyn
(74) *Attorney, Agent, or Firm*—Pro-Techtor International Services

(57) ABSTRACT

An air pressure tube assembly for elevation-adjustable seat stand is constructed to include a barrel, an inner tube mounted inside the barrel, a top cap mounted in one end of the barrel, a first valve and a second valve connected in a line between the top cap and the inner tube inside the barrel, a bottom cap fastened to one end of the inner tube remote from the top cap, a pin adapted to close/open the first valve and the second valve, a bolt fastened to the top cap and extended out of the barrel, a piston assembly axially movably mounted in the inner tube, and small and big O-rings sealed between the parts of the air pressure tube assembly, the top cap, the first valve, the second valve, the inner tube and parts of the piston assembly being respectively injection-molded from plastics.

2 Claims, 2 Drawing Sheets

AIR PRESSURE TUBE ASSEMBLY FOR ELEVATION-ADJUSTABLE SEAT STAND

BACKGROUND OF THE INVENTION

The present invention relates to chairs and, more specifically, to an air pressure tube assembly for elevation adjustable seat stand, which has a simple structure and, is easy and inexpensive to manufacture.

Various air pressure-controlled elevation-adjustable seat stands are well known. Regular air pressure-controlled elevation-adjustable seat stands are commonly comprised of an air pressure tube assembly, which is composed of a big number of parts including barrel, top cap, inner tube, valve means, piston means, pin, bottom cap, and etc. These parts are commonly made of metal. These metal parts are commonly expensive, and their fabrication is complicated. Further, during operation of the air pressure tube assembly, air may leaks out of gaps between metal parts.

SUMMARY OF THE INVENTION

The present invention has been accomplished to provide an air pressure tube assembly for elevation-adjustable seat stand, which eliminates the aforesaid drawbacks. It is one object of the present invention to provide an air pressure tube assembly for elevation-adjustable seat stand, which is inexpensive to manufacture. It is another object of the present invention to provide an air pressure tube assembly for elevation-adjustable seat stand, which prevents air leakage. According to one aspect of the present invention, the air pressure tube assembly is comprised of a barrel, an inner tube mounted inside the barrel, a top cap mounted in one end of the barrel, a first valve and a second valve connected in a line between the top cap and the inner tube inside the barrel, a bottom cap fastened to one end of the inner tube remote from the top cap, a pin adapted to close/open the first valve and the second valve, a bolt fastened to the top cap and extended out of the barrel, and a piston assembly axially movably mounted in the inner tube, wherein the top cap, the first valve, the second valve, the inner tube and parts of the piston assembly are respectively injection-molded from plastics. According to another aspect of the present invention, small and big O-rings are installed in the top cap and the inner tube to seal gaps between the valves, the top cap, the inner tube, and the pin.

DETAILED DESCRIPTION OF THE PREFERRED EMBODIMENT

Figure 1:
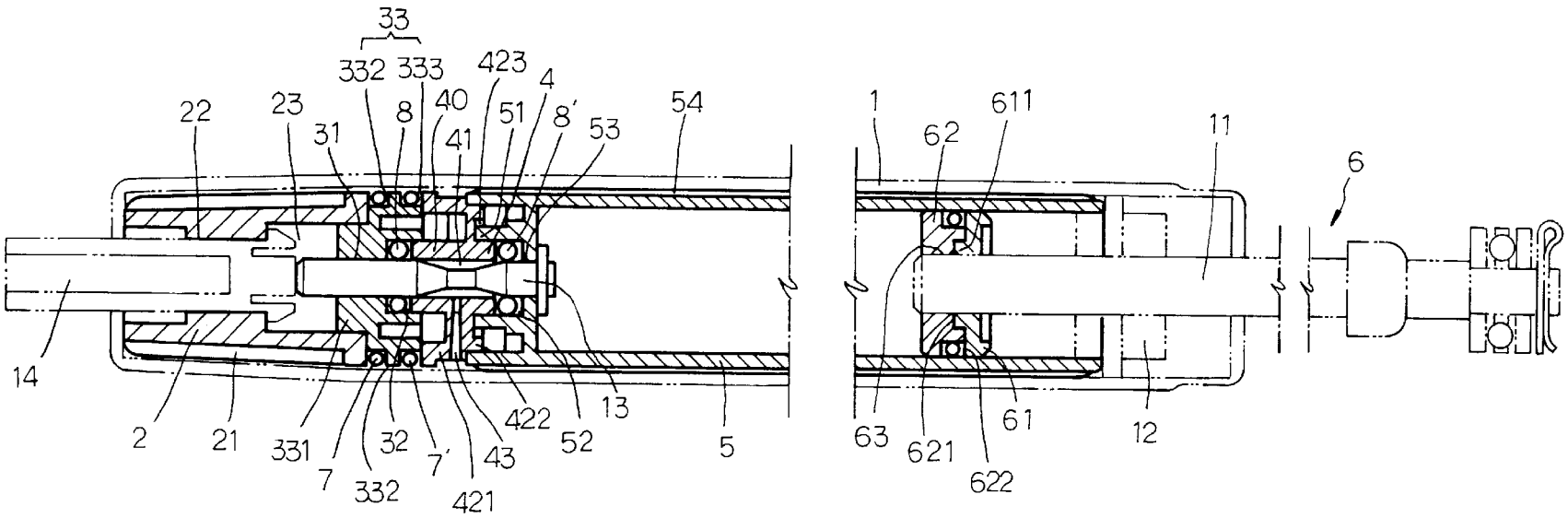
FIG. 1 is a sectional assembly view of the present invention.
Figure 2:
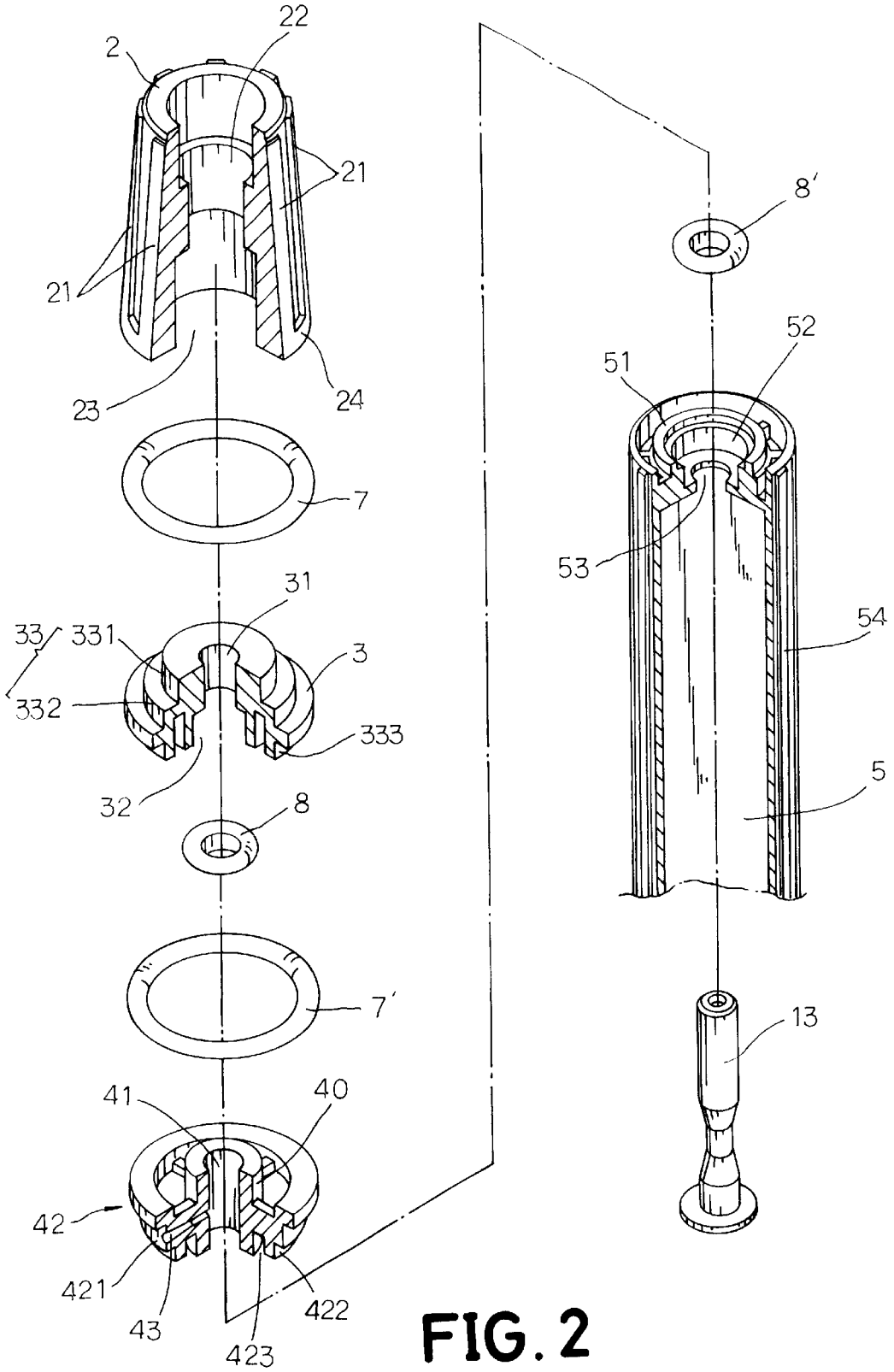
FIG. 2 is an exploded, partially cutaway view of the present invention.

Referring to FIGS. 1 and 2, an air pressure tube assembly is shown comprised of a barrel 1, a top cap 2, a first valve 3, a second valve 4, an inner tube 5, a piston assembly 6, a bottom cap 12, a pin 13, a bolt 14, big O-rings 7 and 7', and small O-rings 8 and 8'. The top cap 2, the first valve 3, the second valve 4, the inner tube 5 and the piston 6 are respectively injection-molded from plastics.

The top cap 2 is shaped like a tapered tube, comprising a bottom flange 24 raised around the periphery of the bottom end thereof, a plurality of longitudinal ribs 21 spaced around the periphery and perpendicularly extended from the bottom flange 24 to the top end thereof, a center through hole 23 extended through the top and bottom end thereof, and a neck 22 in the center through hole 23 adapted to hold the bolt 14 in the center through hole 23.

The first valve 3 comprises a bottom coupling chamber 32, a center hole 31 disposed in communication with the bottom coupling chamber 32, and a stepped peripheral wall 33. The stepped peripheral wall 33 of the first valve 3 comprises a front section 331, which holds one small O-ring 8, a rear section 333, which holds one big O-ring 7', and an intermediate section 332 connected between the front section 331 and the rear section 333, which holds one big O-ring 7.

The second valve 4 comprises a center through hole 41 adapted to receive the pin 13, a front coupling flange 40 adapted for coupling to the bottom coupling chamber 32 of the first valve 3, a stepped peripheral wall 42, an air hole 43 transversely extended through a middle part 421 of the stepped peripheral wall 42 and disposed in communication with the center through hole 41, and an annular coupling groove 423 on the bottom end of a rear part 422 of the stepped peripheral wall 42.

The inner tube 5 is mounted in the barrel 1, comprising a transverse partition wall 52, which blocks one end of the inner tube 5, an annular coupling flange 51 axially forwardly extended from the partition wall 52 and adapted for coupling to the annular coupling groove 423 of the second valve 42, a center through hole 53 extended through the transverse partition wall 52 at the center within the annular coupling flange 51 and adapted to receive the pin 13, and a plurality of longitudinal ribs 54 spaced around the periphery. One small O-ring 8' is mounted on the transverse partition wall 52 inside the annular coupling flange 51, and adapted to seal the gap between the inner tube 5 and the second valve 4. The longitudinal ribs 54 reinforce the strength of the inner tube 5. After mounting in the barrel 1, the longitudinal ribs 54 are disposed in contact with the inside wall of the barrel 1.

The piston assembly 6 is comprised of a piston rod 11, a first piston portion 61, and a second piston portion 62. The first piston 61 comprises a coupling flange 611 raised from one side thereof. The second piston portion 62 comprises a coupling groove 621 disposed at one side thereof and coupled to the coupling flange 611 of the first piston portion 61, and a stepped periphery 622 mounted with one big O-ring 7, which is disposed in contact with the inside wall of the inner tube 5. Further, the first piston portion 61 and the second piston portion 62 each have a center mounting through hole 63 adapted to receive the piston rod 11.

Comparing to conventional designs, the air pressure tube assembly of the present invention is composed of less number of parts. Because the major parts of the air pressure tube assembly are directly injection-molded from plastics, the manufacturing cost of the present invention is low.

While only one embodiment of the present invention has been shown and described, it will be understood that various modifications and changes could be made thereunto without departing from the spirit and scope of the invention disclosed.

What the invention claimed is:

1. An air pressure tube assembly for an elevation-adjustable seat stand, comprised of a barrel, an inner tube mounted inside said barrel, a top cap mounted in one end of said barrel, a first valve and a second valve connected in a line between said top cap and said inner tube inside said barrel, a bottom cap fastened to one end of said inner tube remote from said top cap, a pin adapted to either close or open said first valve and said second valve, a bolt fastened to said top cap and extended out of said barrel, small and big O-rings, and a piston assembly axially movably mounted in said inner tube, wherein:

said top cap, said first valve, said second valve, said inner tube and parts of said piston are respectively injection-molded from plastics;

said top cap is shaped like a tapered tube, comprising a bottom flange raised around the periphery of a bottom end thereof, a plurality of longitudinal ribs spaced around the periphery and perpendicularly extended said the bottom flange to a top end thereof, a center through hole extended through the top and bottom end thereof, and a neck in the center through hole adapted to hold said bolt in the center through hole of said top cap;

said first valve comprises a bottom coupling chamber, a center hole disposed in communication with said bottom coupling chamber and adapted to receive said pin, and a stepped peripheral wall, the stepped peripheral wall of said first valve comprising a front section, which holds one small O-ring, a rear section, which holds one big O-ring, and an intermediate section connected between said front section and said rear section, which holds one big O-ring;

said second valve comprises a center through hole adapted to receive said pin, a front coupling flange coupled to the bottom coupling chamber of said first valve, a stepped peripheral wall, an air hole transversely extended through a middle part of the stepped peripheral wall of said second valve and disposed in communication with the center through hole of said second valve, and an annular coupling groove on a bottom end of a rear part of the stepped peripheral wall of said second valve;

said inner tube comprises a transverse partition wall, which blocks one end of said inner tube and holds one small O-ring in contact with said second valve, an annular coupling flange axially forwardly extended from said partition wall and coupled to the annular coupling groove of said second valve, a center through hole extended through said transverse partition wall at the center within the annular coupling flange of said inner tube and adapted to receive said pin, and a plurality of longitudinal ribs spaced around the periphery thereof and disposed in contact with an inside wall of said barrel.

2. The air pressure tube assembly of claim 1 wherein said piston assembly is comprised of a piston rod, a first piston portion fastened to one end of said piston rod, and a second piston portion fastened to said piston rod and connected to said first piston portion, said first piston comprising a coupling flange raised from one side thereof, and a center mounting through hole, said second piston portion comprising a coupling groove disposed at one side thereof and coupled to the coupling flange of said first piston portion, a center mounting through hole, and a stepped periphery mounted with one big O-ring, which is disposed in contact with an inside wall of said inner tube, said piston rod is fastened to the center mounting through hole of said first piston portion and the center mounting through hole of said second piston portion.

* * * * *